United States Patent [19]

Rausing

[11] 4,266,698

[45] May 12, 1981

[54] OPENING ARRANGEMENT FOR PACKING CONTAINERS OF THIN PLASTIC FILM TOGETHER WITH A PACKING CONTAINER PROVIDED WITH THE OPENING ARRANGEMENT

[75] Inventor: Anders R. Rausing, Lausanne, Switzerland

[73] Assignee: Tetra Pak Developpement SA, Lausanne, Switzerland

[21] Appl. No.: 75,217

[22] Filed: Sep. 13, 1979

[30] Foreign Application Priority Data

Sep. 18, 1978 [CH] Switzerland ..... 9736/78

[51] Int. Cl.[3] ..... B65D 33/36; B65D 75/66; B65D 77/32

[52] U.S. Cl. ..... 222/528; 206/618; 206/633; 220/279; 220/461

[58] Field of Search ..... 206/616, 617, 618, 619, 206/633; 220/403, 462, 463, 416, 279, 258, 461; 229/62, 65, 17, 43; 222/81, 83, 541, 528, 529

[56] References Cited

U.S. PATENT DOCUMENTS

| | | | |
|---|---|---|---|
| 2,364,943 | 12/1944 | Brandt | 220/463 X |
| 2,593,778 | 4/1952 | McGinnis | 229/17 R |
| 2,740,547 | 4/1956 | Hunttins | 220/359 |
| 2,954,901 | 10/1960 | Winstead | 222/541 X |
| 3,139,231 | 6/1964 | Hueschen | 206/617 |
| 3,265,286 | 8/1966 | Inoue | 206/617 |
| 3,481,515 | 12/1969 | Booth et al. | 222/541 X |
| 3,565,329 | 2/1971 | Wagner, Jr. | 206/618 |

FOREIGN PATENT DOCUMENTS

| | | | |
|---|---|---|---|
| 804998 | 3/1951 | Fed. Rep. of Germany | 206/618 |
| 823850 | 11/1959 | United Kingdom | 206/618 |

*Primary Examiner*—Allan N. Shoap
*Attorney, Agent, or Firm*—Burns, Doane, Swecker & Mathis

[57] ABSTRACT

A packing container having an outer casing and a package body disposed within the outer casing is disclosed. A wall portion of the package body is folded over and affixed to itself in the folded position, and a thin cutting thread is arranged within the folded wall portion so that the cutting thread is accessible from outside the packing container. Upon being pulled away from the wall portion, the cutting thread cuts through the wall portion to provide an opening in the package body.

8 Claims, 6 Drawing Figures

OPENING ARRANGEMENT FOR PACKING CONTAINERS OF THIN PLASTIC FILM TOGETHER WITH A PACKING CONTAINER PROVIDED WITH THE OPENING ARRANGEMENT

The present invention relates to an opening arrangement for packing containers of thin plastic film and a packing container provided with such an opening arrangement.

It is known in packing technology that bags or tubes of thin plastic film can be used to form impervious layers in packages which are filled with liquid contents and are then sealed in a tight sealing joint which extends transversely over the said bag or tube. It is known that such bags or parts of tube impervious to liquid can be arranged in an outer casing of circular or polygonal cross-section, the casing being provided with end plates, and it is further known that in cases where the contents are under an internal pressure the sealing joint can be folded and fixed in the folded position in order to reduce the mechanical stresses on the seal.

In packages of the aforementioned kind no convenient opening arrangement exists, rather it has been necessary up to now to open the packages by cutting off the sealed region, e.g. by means of scissors or else by puncturing the package wall with a suitable tool. Thus there is a need for a convenient opening arrangement for the package. Such an opening arrangement is specified in the present invention in which a part of the package wall of the said packing container is folded over and is fixed in the folded position and a thin cutting thread is arranged in the fold thereby formed, which cutting thread is accessible from the outside of the packing container.

Figure 1:
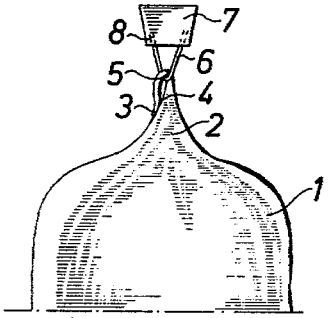
Figure 2:
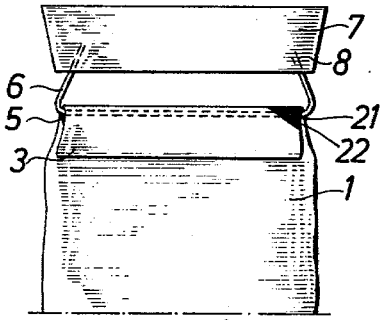
Figure 3:
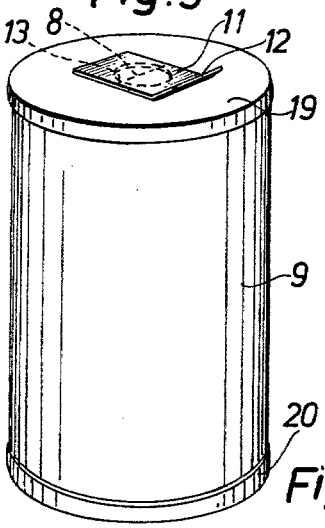
Figure 4:
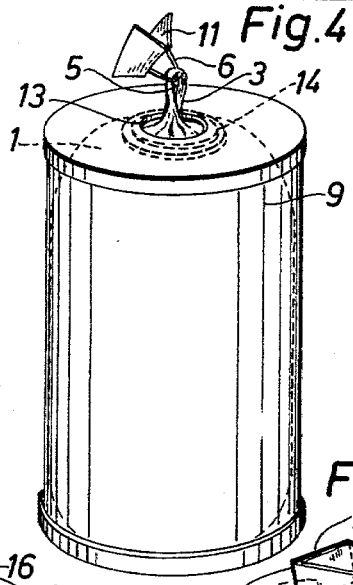
Figure 5:
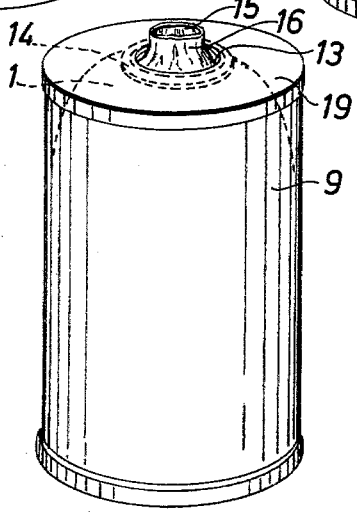
Figure 6:
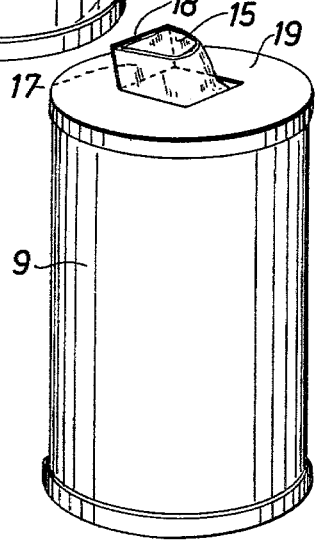

Some embodiments of the invention will be described in the following with reference to the enclosed schematic drawings, wherein FIG. 1 is a front view of a package of this plastic film, the sealing region of which has been gathered together by twisting and where the twisted region has been doubled and fixed in the folded down position and has been provided with an opening arrangement according to the invention, FIG. 2 is a front view of a packing container of thin plastic film where the package wall in the region of the sealing joint has been doubled and fixed in folded position and has been provided with an opening arrangement in accordance with the invention, FIG. 3 is a pictorial view of a packing container consisting of a rigid outer casing which houses an inner package of thin plastic film which is provided with an opening arrangement in accordance with the invention, FIG. 4 is a pictorial view of the packing container according to FIG. 3 when the same is opened so as to make the contents accessible, FIG. 5 is a pictorial view of the packing container in accordance with FIG. 3 after the same has been opened, and FIG. 6 is a pictorial view of a variant of the opening arrangement.

In FIG. 1 is shown the upper part of a package or inner package 1 consisting of a thin plastic film. The contents of the package may consist of a liquid, but they may also be a powder or granulated material. For illustration, however, it is assumed that the contents are a liquid, e.g., milk or juice, or else a liquid containing a gas dissolved in the liquid, which means that a pressure will be created inside the packing container. In the event of the liquid containing a gas dissolved in the same, which is the case, e.g. with beer or carbonated beverages, the packing container must be supported by a rigid outer casing and by end plates, since otherwise there would be a risk of the thin plastic material in the packing container 1 being subjected to such stresses as to cause the material to burst.

It has proved difficult in packages consisting of thin plastic film to pre-arrange perforations or weakenings which would facilitate the opening of the package while at the same time allowing the packages to remain completely sealed, moreover, do not open spontaneously during the normal transport and handling of the packing container in connection with manufacture and distribution. This applies, of course, to an even higher degree to packages which are filled with pressurized contents where the inner pressure will constantly act upon the perforations or weakening lines in the packing material. It is desirable, however, as has been pointed out before, to make possible the opening of packages of the type referred to here, without having recourse to tools such as scissors or a knife.

The packing container 1 provided with the opening arrangement in accordance with the invention has a package body which is manufactured of thin plastic material, e.g. polythene, or, in the event where the contents require a tighter packing material, a laminate which e.g. may incorporate a central gas-proof layer of polyvinyl alcohol or a similar material, and layers of polythene, polypropylene, polyvinyl chloride or polyester. The package body 1 may be constituted either of a seamless tube or of a tube which is manufactured from a web, the longitudinal edges of which are joined together in a sealing joint to form a tube or hose. The said tube is sealed along its end and is filled subsequently with the intended contents, whereupon the tube is closed by a transverse seal to form the packing container 1. The said transverse sealing can be carried out either as a sealing through the contents, when the package 1 will be completely filled with contents, or else the sealing can be carried out above the contents level after a measured predetermined amount of contents has been introduced into the tube. In both cases efforts are made to remove the contents from the region 2 adjoining the sealing joint 3, whereupon the said region 2 is folded over to form a fold 5. The folded over part is fixed in this folded position by a seal 4. In the fold 5 formed is arranged a thin cutting thread 6 of an only slightly extensible material, e.g. oriented nylon thread, steel wire or the like. The said cutting thread 6 forms a loop whose ends are anchored in a gripping part 7 with the help of which the cutting thread 6 can be handled. The said cutting thread 6 should be so thin that it easily cuts through the plastic material when a tensile force is applied on the gripping part 7 and such a cutting effect can be achieved with cutting threads which have a diameter of 0.01–0.05 mm. Beside low extensibility the cutting thread 6 must have high tensile strength, and it has been found that e.g. nylon thread or polyester thread possess these characteristics. Owing to the extreme thinness of the cutting thread the person handling the thread may be in danger of cutting himself, and in order to eliminate this danger the cutting thread 6 is made as short as possible.

In accordance with FIG. 1 the region 2 adjoining the sealing joint 3 of the packing container 1 may be gathered together by twisting, rolling or in some other manner, whereupon the region gathered together is folded over and fixed in the folded position. It is also possible in accordance with FIG. 2, directly to fold over the end portion of the packing container 1 close to the sealing joint 3 to form a fold 5, or else to roll the packing material close to the sealing joint 3, and fix the folded or rolled region of the packing container 1 in the rolled or folded position, e.g. by means of a clip. As in FIG. 1 in FIG. 2, a thin cutting thread 6 is arranged in the region 8 and is anchored in a gripping part 7 with the help of which the tearing thread can be handled. When the package in accordance to FIG. 2 is to be opened the gripping part 7 is pulled upwards, when the cutting thread 6 cuts through the package wall along the fold 5, so that an opening is formed through which the contents can be made accessible. To facilitate the cutting effect of the cutting thread 6, the same can be sealed or otherwise adhered to the thin package foil in the fold 5, e.g through heat-sealing to the outside of the layer of thin packing material against which the cutting thread 6 is arranged. Furthermore, it may be advisable to arrange a cut 21 in a sealed part 22 of the fold 3 at a location near the cutting thread 6 in order to facilitate the initiation of the cut.

As mentioned earlier, it may be appropriate and, if the contents have been pressurized, necessary to surround the packing container 1 of thin plastic material with a rigid outer or pressure-absorbing causing 9. Such a package is shown in FIG. 3–6. In FIG. 3 the outer casing 9 shown may be cylindrical or prismatic, and may be provided with a lid 19 and a base 20. In the lid 19 a hole 13 is incorporated which in FIG. 3 is covered by a covering strip 11 sealed to the top of the lid which has an unsealed pull-lug 12. The packing container 1 described in connection with FIGS. 1 and 2 of thin plastic material is housed in the casing 9 in such a manner that the opening arrangement 2 with the fold 5 and the cutting thread 6 arranged in the fold is accessible through the hole 13. The cover strip 11 acts at the same time as a gripping part for the cutting thread 6 which is anchored in the cover strip 11 along the region 8. This means that the cover strip 11, when it is torn off, will hang together with the cutting thread 6 and when the cover strip 11 is completely torn off, the packing container 1 will be opened at the same time owing to the cutting thread 6 cutting through the packing material in the fold 5, as the opening region of the packing container 1 is pulled out of the hole 13.

The above-mentioned opening procedure is illustrated in FIG. 4 where the inner bag or packing container 1 is illustrated by broken lines. To prevent the opening area from falling in through the hole 13, the packing container 1 is sealed to the underside of the lid part 19 along a sealing area 14 adjoining the hole 13. In the case shown it is assumed that the opening region 2 is gathered together, e.g. by twisting so as to form a concentrated part of small extension in transverse direction. However, if the opening is to be designed in accordance with FIG. 2, the hole 13 instead of being a central circular hole, must be an elongated slit.

In FIG. 5 is shown how the opening 15 is established after the folded part of the opening arrangement has been cut off by means of the cutting thread 6. The collarlike part 16 of the packing container 1 defines a pouring opening 15 which projects above the lid 19 and is prevented from falling into the outer casing 9 by the inner packing container 1 due to the thin plastic material being fixed to the inside of the lid 19 in the region 14 around the hole 13.

It is also possible to substitute the cover strip 11 by a part of the lid 19 which can be torn off with the help of perforations, the cutting thread 6 being anchored in the said tear-off part of the lid 19, which is torn off on opening the package, the cutting thread 6 cutting at the same time in the manner described above, through the sealed fold, so that a pouring opening 15 is established. In an opening arrangement of the above-mentioned type the inner packing container 1 may be fixed, as shown in FIG. 6, to a lift-up lug 18 of the lid 19 along a region 17 on the inside of the said lug. The said lift-up lug 18 may constitute an extension of the part of the lid 19 which with the help of a perforation can be torn off so as to form a gripping part 11 for the cutting thread 6. The opening arrangement in accordance with FIG. 6 may be appropriate e.g. in an opening construction according to FIG. 2 where the material of the tube 1 is not gathered together by twisting or in some other manner after sealing along the sealing region 3, but is only rolled or folded. To avoid an opening region which is too long it is possible in the sealing mode according to FIG. 2 to form the part of the tube 1 intended for sealing first so as to form a so-called bellows-fold, in this arrangement inwardly directed folds are formed on one side or on opposing sides of the tube, these are fixed by a transverse sealing of the tube along the region provided with bellows-folds. By establishing such bellows-folds in the tube the length of the sealing region is reduced, which also means that the width of the opening in the lid 19 in accordance with FIG. 6 can be reduced to a corresponding extent. In the package in accordance with FIG. 6 it has been assumed that the inner packing container or tube 1 has been provided with an aforementioned bellows-fold which subsequently by folding over or rolling has been made to form an opening arrangement in accordance with the invention, with a cutting thread 6 arranged in the fold 5 that has been formed and fixed. The package wall adjoining the opening region is fixed in the aforementioned manner on the lift-up lug 18 along the sealing region 17 so as to form a stable and well-defined pouring opening which is established when a part 10 of the lid part 19 is torn off along a perforation, the cutting thread 6 is anchored to the lid part 19 and cuts through the inner thin plastic container 1 in the fold 5 adjoining the sealing region 3.

The abovementioned embodiments are intended to serve only as examples of the invention and may be modified within the framework of the invention, e.g. in that only one end of the cutting thread 6 is anchored in a gripping part, while the other end of the cutting thread may be anchored e.g. in the lid 19. It is also possible to use cutting threads which are not of a circular cross-section but which are provided with a cutting edge or which are serrated or machined in some other manner so as to enhance the cutting effect.

I claim:

1. A packing container comprising:

an outer casing including a first and a second end portion, said casing having an opening in said first end portion;

a package body disposed within said outer casing, said body having a thin flexible wall;

means for holding a portion of the wall in a folded position to form a fold therein;

a cutting thread disposed within said fold;

closure means on said opening, said cutting thread being secured to said closure means, whereby when said closure means is pulled from said opening, said cutting thread cuts through said portion of the wall to provide an opening therein.

2. The packing container of claim 1 wherein the outer casing is substantially cylindrical.

3. The packing container of claim 1 wherein said closure means comprises a removable cover strip affixed to said first end portion.

4. The packing container of claim 3 wherein said cutting thread is attached to said cover strip such that said cutting thread cuts through said portion of the wall as said cover strip is removed.

5. The packing container of claim 3 wherein said cover strip includes a lug which may be lifted to remove said strip.

6. The packing container of claim 3 wherein said cutting thread passes through said fold and each end of said cutting thread is attached to said cover strip.

7. The packing container of claim 1 wherein said portion of the wall which is held in a folded position is arranged directly beneath said opening, and wherein said portion of the wall has a substantial length whereby said portion of the wall projects through said opening to form a pouring spout when said closure means is removed.

8. The packing container of claim 7 wherein a portion of said wall of said package body is affixed to an inner surface of said outer casing around said opening to prevent said pouring spout from falling back through said opening subsequent to being formed.

* * * * *